United States Patent [19]

Czech et al.

[11] 4,345,129

[45] Aug. 17, 1982

[54] ELECTRICAL SWITCH

[75] Inventors: Franz Czech, Niederhasli; Gerhard Mauthe, Birmenstorf; Hans Pfrötzschner, Wettingen, all of Switzerland

[73] Assignee: BBC Brown, Boveri & Company, Ltd., Baden, Switzerland

[21] Appl. No.: 131,844

[22] Filed: Mar. 19, 1980

[30] Foreign Application Priority Data

Apr. 3, 1979 [CH] Switzerland ..... 3079/79

[51] Int. Cl.[3] ..... H01H 1/38; H01H 1/44

[52] U.S. Cl. ..... 200/163; 200/255; 200/260

[58] Field of Search ..... 200/252, 254, 255, 260, 200/163

[56] References Cited

U.S. PATENT DOCUMENTS

| | | | |
|---|---|---|---|
| 2,300,893 | 11/1942 | Hayford | 200/163 |
| 2,303,425 | 12/1942 | Bickham | 200/163 |
| 2,376,818 | 5/1945 | Rubel | 200/163 |
| 2,433,115 | 12/1947 | Green | 200/255 |
| 2,458,792 | 1/1949 | Nijland | 200/163 |
| 2,923,800 | 2/1960 | Borde et al. | 200/163 |
| 3,560,688 | 2/1971 | Bachler | 200/260 |
| 4,087,668 | 5/1978 | Nakanishi et al. | 200/255 |
| 4,188,516 | 2/1980 | Patel et al. | 200/163 |

FOREIGN PATENT DOCUMENTS

| | | | |
|---|---|---|---|
| 2739152 | 2/1979 | Fed. Rep. of Germany | 200/163 |

*Primary Examiner*—John W. Shepperd

*Attorney, Agent, or Firm*—Burns, Doane, Swecker & Mathis

[57] ABSTRACT

An electric switch having contact elements designed in the form of contact pins is disclosed. Contact pins and flat springs are arranged in units, each unit having a contact pin and an associated flat spring, and each unit extending in the make/break direction of the switch. Each contact pin-flat spring unit is held between a contact carrier and a cage. The cage may be held in place by outer ends of the flat springs. A tubular conductor or a contact blade can be used as a mating contact. The mating contact is in electrical connection with the contact pins when the switch is in the make position. The individual contact elements can be easily replaced, and a standard design contact element can be used in switches of various sizes and types. A switch according to the present invention is particularly suitable for use with large surge currents.

15 Claims, 9 Drawing Figures

ELECTRICAL SWITCH

BACKGROUND OF THE INVENTION

This invention relates generally to electric switches, and more particularly to an electric switch having contact elements which are provided with spring members, which are arranged on at least one contact carrier, and which are intended to mate with a contact having at least one tubular conductor or at least one contact blade.

One such conventional switch is taught in the published German Patent Application 11 91 465. The switch taught therein is intended for handling large surge currents, and has a contact comprising a slotted elastic tube. When the switch is in the make position, the slotted tube is mated with a solid contact. Once so mated, the contact segments formed by slotting the tube are forced against the solid contact by the inherent springiness of the contact segments themselves, and by forces supplied by additional springs.

A switch according to this conventional design requires slotted contact segments which are relatively long in order that the contact segments are able to respond to the pressure of the additional springs. Such a structure creates a long current path which results in high short circuit forces and heat generation. Moreover, even if only one of the slotted contact segments becomes mechanically damaged or burned, it is necessary to replace the entire slotted tube.

It is an object of the present invention to provide an electric switch in which the dimensions of the contact elements in the make/break direction, as well as in the cross-section direction, are relatively small.

Yet another object of the present invention is to provide an electric switch in which individual contact elements can be easily replaced. Moreover, it is an object of the present invention to provide contact elements which can be used in switches of various sizes, and which allow short connections, even when used in conjunction with tubular conductors having large diameters.

SUMMARY OF THE INVENTION

According to a preferred embodiment of the present invention, contact elements are designed in the form of contact pins. Each contact pin is associated with a flat spring which extends in the circuit make/break direction of the switch. The flat springs and the contact pins are held between a contact carrier and a cage. The ohmic resistance of each contact pin is smaller than that of its associated flat spring. The contact carrier may be made of copper; the contact pins of hard electrolytic copper; the flat springs of slabbed spring steel wire, and the cage of glassfiber reinforced polyamide.

According to a preferred embodiment of the present invention, a contact pin and a flat spring are mated to each other so as to form a single unit in order to facilitate assembly and disassembly of the switch.

According to the present invention, each contact pin can be individually replaced. The dimensions of the contact pins can be kept relatively small, thereby permitting a standarized contact pin to be used in switches of various sizes. A switch according to the present invention provides a short current path and thus relatively small short circuit forces.

BRIEF DESCRIPTION OF THE DRAWINGS

The preferred embodiments of the present invention are described with reference to the accompanying drawings wherein like members bear like reference numerals and wherein.

DESCRIPTION OF THE PREFERRED EMBODIMENTS

Figure 1:
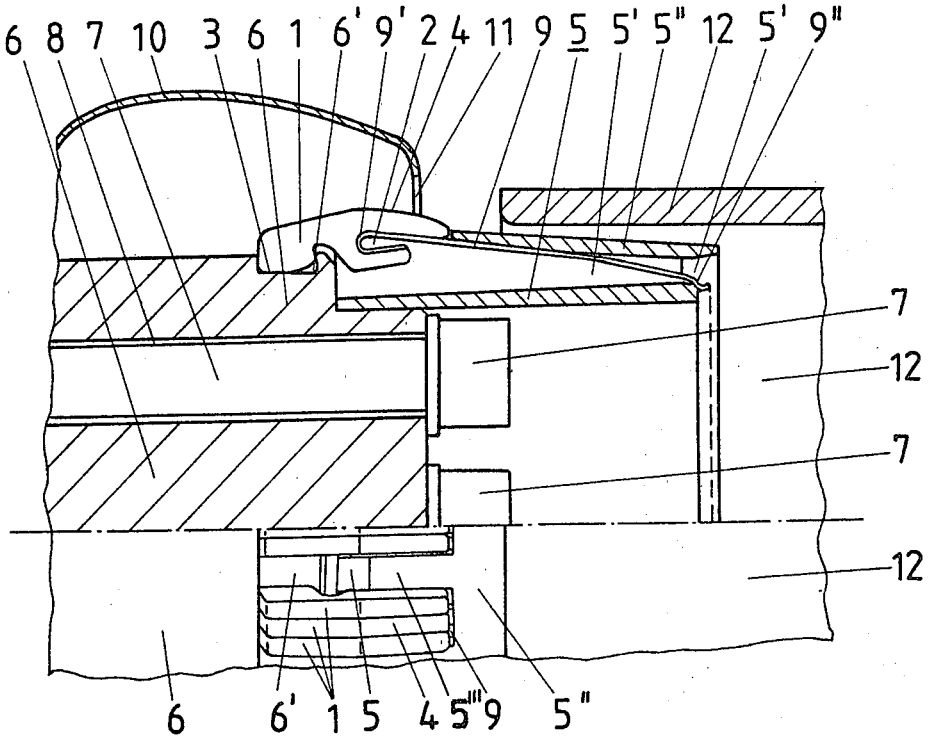
FIG. 1 is a view, partially in cross-section, of a switch according to the present invention in which contact elements are arranged at the outer surface of a cylindrical contact carrier.

Referring to FIG. 1, an electric switch includes a contact pin 1 having a recess 2, and a flat spring 9 having ends 9′ and 9″. The recess 2 is substantially larger than the thickness of the flat spring 9. The end 9′ of the flat spring is bent so as to form a loop, and the loop is accommodated in the recess 2. The spring force exerted by the looped end 9′ of the flat spring against the inner surface of the recess firmly holds the contact pin and the flat spring together as a unit. Arranging the contact pin and the flat spring together as a unit facilitates assembly and disassembly of the switch.

The contact pin 1 has a contact area 3 which makes contact with a contact carrier 6. The contact pin 1 also has a contact area 4 which makes contact with a tubular conductor 12 when the switch is in the make position.

The flat springs 9 are arranged within a cage 5 which has a recess 5′ and an outer part 5″. The outer part 5″, which supports the flat springs 9, is provided with slots and teeth 5‴ so that it is designed in a comb-like fashion as best illustrated in the lower half of FIG. 1. The cage 5 is held in place by the inwardly bent ends 9″ of the flat springs 9. The right edge of the cage 5 is thus held resiliently in place, allowing the cage to follow any non-coaxial position of the tubular conductor 12. Preferably, the cage is conical and the outer, tapered surface of the outer part 5″ of the cage cooperates with the tubular conductor 12 so as to center and support the tubular conductor about the cage.

The contact pin-flat spring units are arranged in groups of three within the slots of the cage 5, and several such groups are arranged at the perimeter of the cylindrical contact carrier 6. The contact carrier 6 includes an annular groove 6′ which accommodates the ends of the contact pins 1 having the contact area 3. As such, the contact pins 1 are swivel-mounted on the contact carrier. Swivel-mounting the contact pins in the groove of the contact carrier fixes the position of the contact pins in the make/break direction of the switch.

The contact carrier 6 includes bores 8 which accommodate fastening bolts 7. The fastening bolts 7 connect the contact carrier to a first conductor (not illustrated). The tubular conductor 12 is connected to a second conductor (not illustrated). When the electric switch is in the break position illustrated in FIG. 1, the first conductor is electrically disconnected from the second conductor. As the switch goes from the break position to the make position, the tubular conductor 12 comes in contact with the contact areas 4 of pins 1. In the make position, the tubular conductor 12, the contact pins 1 and the contact carrier 6 form a circuit which electrically connects the first conductor to the second conductor.

The contact carrier 6 may have a casing 10. The casing 10 protects the end of the tubular conductor when the switch is in the make position, and protects part of the contact pins 1. The case 10 includes a cut-out 11 which accommodates the tubular conductor in the make position. The casing 10 is not illustrated in the lower half of FIG. 1.

The contact region between the contact area 3 of the pin 1 and the contact carrier 6 may be shaped as desired. The contact pressure between the contact area 3 and the contact carrier 6 is generated by the flat springs 9. The contact pressure is increased when the switch is in the make position and the tubular conductor 12 is in contact with the contact areas 4 of the contact pins and depresses the contact pins radially inwardly.

Figure 2:
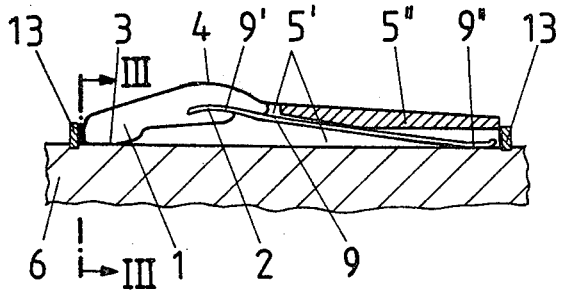
FIG. 2 is a cross-section view of a switch according to the present invention in which the contact elements are fixed in the make/break direction by fastening rings included on the contact carrier.

Referring to FIG. 2, a compact electric switch includes a contact pin 1 having a recess 2, and a flat spring 9 having ends 9′ and 9″. The recess 2 is equal in size to the thickness of the flat spring, and accommodates the end 9′ of the spring. So accommodated, the contact pin 1 and the flat spring 9 form a unit.

In this embodiment, the cage includes an outer part 5″ and a recess 5′. The contact pins 1 are held in the comb-shaped recesses 5′ of the cage such that the outer ends 9″ of the flat springs 9 rest directly at the contact carrier 6.

Fastening rings 13 are accommodated in shallow grooves included in the contact carrier 6. Alternatively, the fastening rings can be attached to the contact carrier by heat shrinking. The fastening rings 13 fix the contact pin-flat spring units and the cage in the make/break direction of the electric switch.

Figure 3:
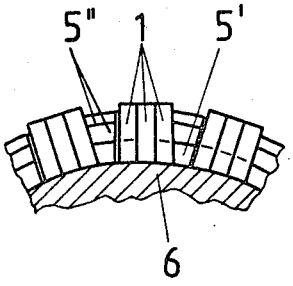
FIG. 3 is a cross-section view through the line III—III of FIG. 2.

Referring to FIG. 3, a view through the line III—III of FIG. 2 is illustrated. As in the embodiment illustrated in FIG. 1, the contact pins 1 are arranged in groups of three, and several such groups are arranged around the perimeter of the contact carrier 6.

Figure 4:
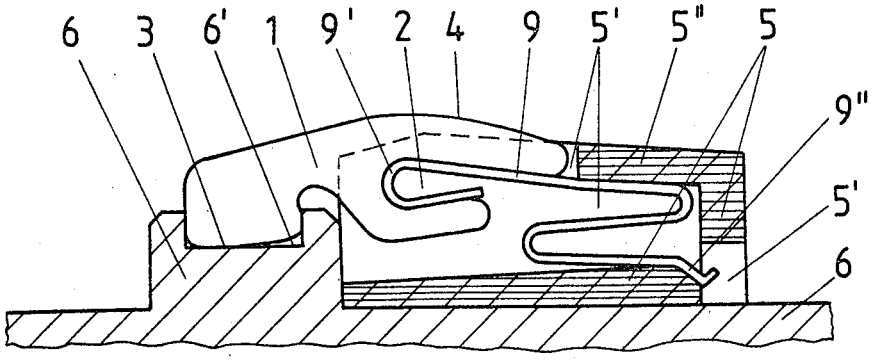
FIG. 4 is a cross-section view of a switch according to the present invention in which a flat spring includes a plurality of bends.

Referring to FIG. 4, another embodiment of the present invention is illustrated in which the flat spring 9 is bent repeatedly, thereby reducing the length of the switch in the make/break direction. The contact pin 1 is swivel-mounted in the groove 6′ of the contact carrier 6. An outer end 9″ of the flat spring 9 presses the cage 5 against the contact carrier 6 as well as in the direction of the contact pin 1.

Figure 5:
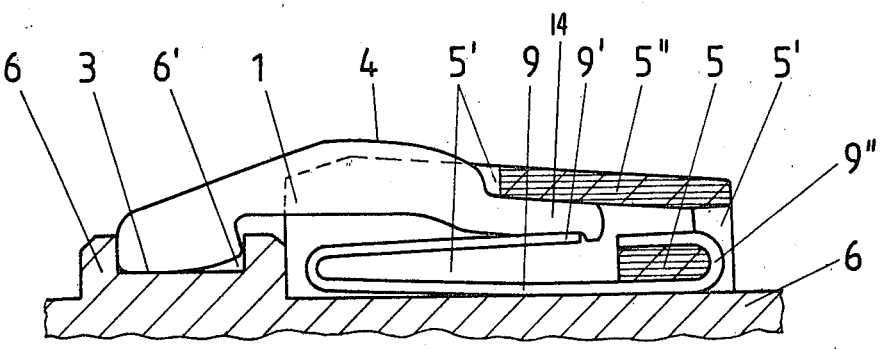
FIG. 5 is a cross-section view of a switch according to the present invention in which the flat spring engages a portion of a cage.

Referring to FIG. 5, another embodiment of the present invention is illustrated in which the contact pin includes a projection, rather than a recess, to accommodate the flat spring. In this embodiment, an end 9′ of the flat spring 9 lies against a projection 14 of the contact pin 1, and a bent end 9″ of the flat spring 9 engages a portion of the cage 5. The cage 5 is held by the bent end 9″ of the flat spring.

Figure 6:
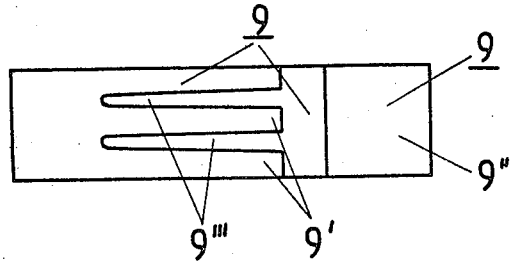
FIG. 6 is a top view of the flat spring illustrated in FIG. 5.

In this embodiment, only one flat spring 9 is used for each group of three contact pins. FIG. 6 illustrates a top view of the flat spring 9. The end 9′ of the flat spring which supports the three contact pins 1 is provided with slots 9‴ such that there are three ends 9′. Each of the three ends 9′ independently support a contact pin 1.

Figure 7:
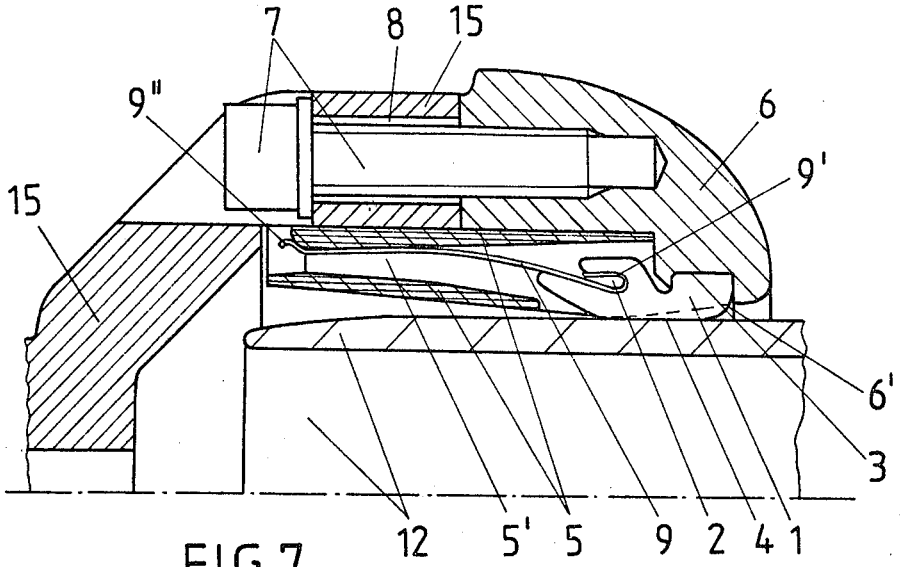
FIG. 7 is a cross-section view of a switch according to the present invention in which the contact elements are arranged inside the contact carrier.

Referring to FIG. 7, another embodiment of the present invention is illustrated in which the contact pins 1, the flat springs 9 and the cage 5 are arranged inside a cylindrical contact carrier 6. The contact carrier 6 is connected to a conductor part 15 by fastening bolts 7. The tubular conductor 12 is illustrated in the make position.

Figure 8:
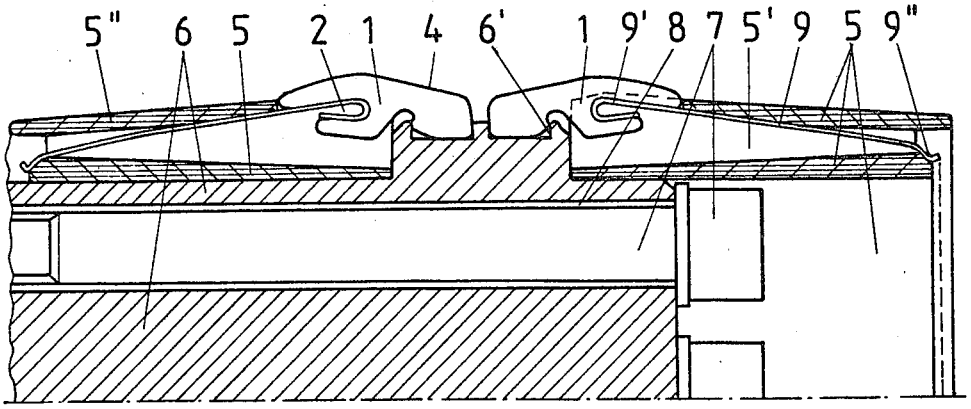
FIG. 8 is a cross-section view of a switch according to the present invention in which two rows of contact elements are arranged in mirror-image fashion.

Referring to FIG. 8, another embodiment of the present invention is illustrated in which two rows of contact pins 1 are arranged at a contact carrier 6 in mirror-image fashion. Fastening bolts 7 connect the contact carrier 6 with a first conductor (not illustrated). The embodiment illustrated is designed to serve as a contact piece for a tubular conductor arriving from the right. Alternatively, in place of the contact carrier 6 and fastening bolts 7, a circular or cylindrical contact carrier shorter than the axial length of the two contact elements may be used. The alternate embodiment would accommodate a tubular conductor at both sides, and thus can serve as a tubular conductor coupling.

The two rows of contact pins are electrically connected in series. Alternatively, there may be more than two rows of contact pins. And, alternatively the pins may be arranged in a unidirectional rather than a mirror-image fashion. The arrangement of two or more rows of contact pins makes it possible for a switch having given contact element and contact carrier dimensions to handle larger currents, with only the first row of contact pins being exposed to substantial arcing.

Figure 9:
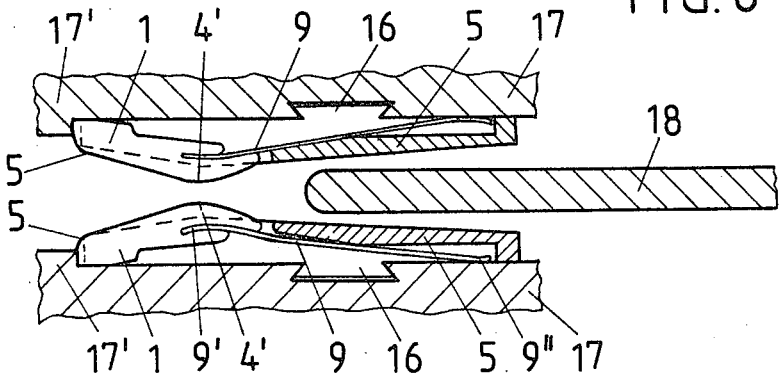
FIG. 9 is a cross-section view of a switch according to the present invention having two plate-shaped contact carriers and a flat contact blade.

Referring to FIG. 9, another embodiment of the present invention is illustrated in which two cages 5 are connected to plate-shaped contact carriers 17 by dovetail joints 16. A contact pin 1 rests at a step-shaped rise 17′ of the contact carrier 17. A flat contact blade 18 is illustrated in the break position. In the make position, the flat contact blade is in contact with a contact area 4′ of the contact pin 1. Alternatively, the contact carrier may be ring-shaped or pot-shaped.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Moreover, variations and changes may be made by those skilled in the art without departing from the spirit of the present invention.

What is claimed is:

1. An electric switch comprising:

first and second conductors, at least one of said conductors having a central opening into which the other conductor is inserted during a circuit making operation so that said one conductor overlies said other conductor when the switch is in its circuit-making position;

a plurality of contact elements disposed between said first and second conductors when they are in the circuit-making position to electrically connect said conductors, each of said contact elements including a contact pin having one end disposed on one of said conductors, and a flat spring having one end operatively connected to the other end of said contact pin, said contact pin and spring forming a unit extending in the circuit making/breaking direction of movement of said conductors relative to one another; and a cage member resiliently held in place on the conductor on which said contact pins are disposed by the other ends of said flat springs.

2. The switch according to claim 1 wherein said cage member has a conical shape.

3. The switch according to claim 1 wherein said cage member accommodates at least two contact pins arranged side-by-side.

4. The electric switch of claim 1 wherein said one end of each of said flat springs is clamped onto said other end of its associated contact pin.

5. The electric switch of claim 1 wherein the conductor on which said contacts are disposed includes a groove, said one end of each of said contact pins being disposed within said groove so as to be swivel-mounted on said conductor.

6. The electric switch of claim 1 wherein said cage member is fixedly connected to the conductor on which said contact pins are disposed.

7. The electric switch of claim 1 wherein said one conductor having the central opening is the conductor on which said contact pins are disposed, and wherein said contact pins are disposed on the internal surface of said one conductor.

8. The electric switch of claim 7 wherein the other of said conductors is a contact blade.

9. The electric switch of claim 1 wherein said flat springs each include a plurality of bends.

10. The electric switch of cliam 1 wherein said one conductor having a central opening is tubular.

11. The electric switch of claim 10 wherein said contact pins are disposed on said other conductor.

12. An electric switch comprising:

first and second conductors, at least one of said conductors having a central opening into which the other conductor is inserted during a circuit making operation so that said one conductor overlies said other conductor when the switch is in its circuit-making position;

a plurality of contact elements disposed between said first and second conductors when they are in the circuit-making position to electrically connect said conductors, each of said contact elements including a contact pin having one end disposed on one of said conductors, and a flat spring having one end operatively connected to the other end of said contact pin, said contact pin and spring forming a unit extending in the circuit making/breaking direction of movement of said conductors relative to one another; and at least two cage members mounted on the conductor on which said contact pins are disposed in the make/break direction and supporting the other ends of said flat springs in at least two rows in mirror image fashion.

13. The switch according to claim 12 wherein said at least two rows are arranged in a unidirectional fashion.

14. An electric switch comprising:

first and second conductors, one of said conductors having a central opening into which the other conductor is inserted during a circuit making operation so that said one conductor overlies said other conductor when the switch is in its circuit-making position, and at least one of said conductors including a step-shaped rise;

a plurality of contact elements disposed between said first and second conductors when they are in the circuit-making position to electrically connect said conductors, each of said contact elements including a contact pin having one end disposed on the step-shaped rise on said at least one conductor, and a flat spring having one end operatively connected to the other end of said contact pin, said contact pin and spring forming a unit extending in the circuit making/breaking direction of movement of said conductors relative to one another; and a cage member mounted on said at least one conductor and supporting the other ends of said flat springs.

15. An electric switch comprising:

first and second conductors, one of said conductors having a central opening into which the other conductor is inserted during a circuit making operation so that said one conductor overlies said other conductor when the switch is in its circuit-making position;

a plurality of contact elements disposed between said first and second conductors when they are in the circuit-making position to electrically connect said conductors, each of said contact elements including a contact pin having one end disposed on one of said conductors, and a flat spring having one end operatively connected to the other end of said contact pins, said contact pin and spring forming a unit extending in the circuit making/breaking direction of movement of said conductors relative to one another;

a cage member mounted on the conductor on which said contact pins are disposed and supporting the other ends of said flat springs; and a pair of longitudinally spaced fastening rings on a circumferential surface of the conductor on which said contact pins are disposed, said contact pins and their associated springs and said cage member being disposed between said fastening rings to thereby fix their position in the circuit making/-breaking direction of relative movement of said conductors.

* * * * *